US006147346A

United States Patent [19]

Itoi

[11] Patent Number: 6,147,346

[45] Date of Patent: Nov. 14, 2000

[54] MASS SPECTROMETER

[75] Inventor: Hiroto Itoi, Kyoto, Japan

[73] Assignee: Shimadzu Corporation, Kyoto, Japan

[21] Appl. No.: 09/154,746

[22] Filed: Sep. 17, 1998

[30] Foreign Application Priority Data

Sep. 19, 1997 [JP] Japan ..... H9-273592

[51] Int. Cl.[7] ..... H01J 49/10

[52] U.S. Cl. ..... 250/288; 250/423 R

[58] Field of Search ..... 250/288, 423 R

[56] References Cited

U.S. PATENT DOCUMENTS 3,555,272 1/1971 Munson et al. ..... 250/288

4,266,127 5/1981 Chang ..... 250/288

FOREIGN PATENT DOCUMENTS 53-87791 8/1978 Japan ..... 250/288

*Primary Examiner*—Jack Berman

*Attorney, Agent, or Firm*—Armstrong, Westerman, Hattori, McLeland & Naughton

[57] ABSTRACT

A mass spectrometer with an ionizing chamber in which either of an NCI ion source for producing negative ions and a PCI ion source for producing positive ions is placed. The NCI ion source has a first gas inlet and a second gas inlet, while the PCI ion source has only one gas inlet. In the wall of the ionizing chamber are provided a sample gas inlet and a reaction gas inlet. At an end of the sample gas inlet inside of the ionizing chamber is provided a splitter having a first branch and a second branch. When the NCI ion source is placed in the ionizing chamber, the first gas inlet is connected to the first branch, the second gas inlet is connected to the reaction gas inlet inside of the ionizing chamber, and the second branch is left unconnected inside of the ionizing chamber. By adequately adjusting the flow resistances of the first and second branches, a desired portion of the reference gas from the sample gas source can be supplied to the NCI ion source when a calibration is performed. After the calibration is finished, the residual gas and ions in the NCI ion source are evacuated to the ionizing chamber through the first gas inlet, first branch and second branch. When the PCI ion source is placed in the ionizing chamber, the sole gas inlet is connected to the first branch, and the second branch is connected to the reaction gas inlet. The reference gas and the reaction gas are mixed together at the splitter and delivered to the PCI ion source.

8 Claims, 2 Drawing Sheets

MASS SPECTROMETER

The present invention relates to a mass spectrometer, especially to that equipped with an ionizer for ionizing a sample gas using the chemical ionization method.

BACKGROUND OF THE INVENTION

According to the chemical ionization method, ions are produced as follows. A reaction gas such as methane, isobutane or ammonia is introduced in an ionizing chamber to the pressure of around 1 Torr, and the reaction gas molecules are ionized by high speed electrons. Electron impact ionization (EI) is one of such ionization methods.

The ions thus produced, which are referred to as "reaction ions", react with molecules of a sample gas also introduced into the ionizing chamber, and another kind of ions are generated through the ion-molecule reactions. The new ions have a typical structure of $[M+H]^+$where M is the molecule of the sample gas and H is the hydrogen ion produced by the previous ionization. The ions are delivered to the mass spectrometer section where a mass spectrum is constructed, and the sample is identified based on the mass spectrum.

When simply a "chemical ionization" is referred to, it means, in many cases, such a process as described above and in which positive ions are produced. But, there also exists another chemical ionization method in which negative ions are produced. In the following description of the present specification, the chemical ionization producing positive ions are called Positive Chemical Ionization (PCI) and that producing negative ions are called Negative Chemical Ionization (NCI).

FIG. 4 shows the ionizing part of a conventional mass spectrometer, where the door (not shown) of the ionizing chamber 42 is open to show the inside. The door of the ionizing chamber closes the ionizing chamber 42 air-tightly. Though not shown in the drawing, a vacuum pump is provided for evacuating the ionizing chamber 42.

In the ionizing chamber 42 is placed an ion source 44, to which a gas inlet 44*a* is provided. The gas inlet 44*a* is connected with a flexible tube 46 to a gas introducing pipe 48 which hermetically penetrates a side wall of the ionizing chamber 42. At the external end of the gas introducing pipe 48 is provided a connector 49 having two inlets: one connected with a sample gas path 50 to a sample gas source 52, and the other with a reaction gas path 54 to a reaction gas source 56. On the sample gas path 50 are provided a flow resistance 58 and a flow control valve 59. On the reaction gas path 54 is provided another flow resistance 60.

Since proper conditions, such as temperature, pressure, etc., for producing ions differ depending on the methods of ionization, a separate ion source 44 is prepared for each of the ionization method, such as an ion source 44 for PCI and an ion source 44 for NCI. The user chooses an appropriate ion source 44 corresponding to the ionization method he or she intends to use, and places it on a fixed position of the ionizing chamber 42.

The calibration of the mass spectrometer is conducted as follows. When the PCI method is used, the user places the PCI ion source 44 in the ionizing chamber 42, and connects the sample gas path 50 to a sample gas source 52 containing a reference gas. Thus the reference gas and the reaction gas are mixed and introduced through the connector 49 to the PCI ion source 44, where positive ions of the reference gas molecules are produced. The ions are then delivered to the mass spectrometric section (not shown) to obtain a mass spectrum of the reference gas. When NCI method is used, the NCI ion source 44 is placed in the ionizing chamber 42 and the same operation as above is conducted. Perfluorotributylamine (PFTBA) gas is usually used as the reference gas both in the PCI method and in the NCI method.

NCI method has a high detecting sensitivity especially for halogen compounds and nitrogen compounds. That is, more ions are produced in the NCI method than in the PCI method when the same amount of halogen compound gas or nitrogen compound gas is introduced into the ion source. The above described PFTBA gas used as the reference gas commonly in the NCI method and in the PCI method is a fluorine compound, i.e., one of halogen compounds. In calibrating a mass spectrometer, the ions of the reference gas are sufficiently produced in the NCI method from a small amount of reference gas, and a peak or peaks of the reference gas clearly appear in the mass spectrum. In the PCI method, however, a larger amount of the reference gas is needed to produce the same amount of ions and to build an adequate height of peak or peaks of the reference gas in the mass spectrum. Though the ionizing efficiency may be enhanced by increasing the pressure in the ionizing chamber, the difference in the ionizing efficiency of the two ionization methods is apparent.

Regarding the difference in the ionizing efficiency of the reference gas, it is preferable to change the flow rate of the reference gas to the ionizing chamber depending on the ionization method in order to conduct the calibrations at the same proper sensitivity. That is, a larger flow rate of the reference gas is needed in the PCI method and a smaller flow rate is needed in the NCI method. Thus, as shown in FIG. 4, the flow control valve 59 is provided on the sample gas path 50.

One of the problems in the conventional system lies here. Since the flow rate of the reference gas is very small, usually 0.01–0.1 milliliter/minute, a flow control valve 59 of correspondingly high sensitivity is necessary. This considerably increases the cost of the mass spectrometer.

Another problem about calibration in the NCI method is as follows. After a calibration using the reference gas is finished, the reference gas and its ions should be evacuated from the ion source before a measurement on an object sample is started. Ion sources used in the chemical ionization methods are normally designed to be highly air-tight for the purpose of higher ionizing efficiency, so that the walls of the ion sources have minimum tiny holes necessary only for letting the electrons in and for delivering ions produced therein to the mass spectrometric section. The residual ions and gas in the ion source are discharged only through such minute holes. In the PCI method, the number of ions produced is not so large, as explained before, so that the residual ions after calibration can be discharged from the ion source and from the inside of the pipe or tube thereto in a rather short time after the flow of the reference gas is stopped. In the NCI method, on the other hand, more ions are produced even if the flow rate of the reference gas is reduced. Thus it takes more time to evacuate residual ions or gas from the ion source, which lowers the speed of measurement in the NCI method.

SUMMARY OF THE INVENTION

An object of the present invention is therefore to provide a mass spectrometer usable in both the PCI mode and the NCI mode with a high efficiency at a rather low cost. Another object of the present invention is to provide a mass spectrometer which the residual ions and gas can be evacuated from the ion source in a shorter time so that the subsequent measurement of an unknown sample can be started earlier.

According to the present invention, a mass spectrometer includes an ionizing chamber in which either of a first ion source and a second ion source is placed, and the mass spectrometer comprises:

a first gas inlet and a second gas inlet provided to the first ion source;

a third gas inlet provided to the second ion source;

a sample gas inlet passing through a wall of the ionizing chamber;

a splitter provided at an end of the sample gas inlet inside of the ionizing chamber having a first branch and a second branch; and a reaction gas inlet passing through the wall of the ionizing chamber.

The sample gas inlet is provided for introducing the sample gas or the reference gas into the ionizing chamber or further to the ion source, and the reaction gas inlet is provided for introducing the reaction gas into the ionizing chamber and further to the ion source. The first branch of the splitter is connectable to the first gas inlet of the first ion source or to the third gas inlet of the second ion source. Such connections can be realized by a flexible tube such as a teflon tube. The end of the reaction gas inlet inside of the ionizing chamber is connectable to the second inlet of the first ion source or to the second branch of the splitter. Such connections can also be realized by a flexible tube such as a teflon tube.

In the above mass spectrometer, the first ion source having two gas inlets and the second ion source having one gas inlet are selectively placed in the ionization chamber according to the type of a sample gas and an ionization method selected by the user. In detail, the first ion source is selected when the amount of ions produced from the sample gas by the selected ionization method is large, and the second ion source is selected when the amount of ions produced from the sample gas by the selected ionization method is small.

For example, when the mass spectrometer is used in the NCI mode and the sample gas is a fluorine compound gas: the first ion source (or NCI ion source) is placed in the ionizing chamber; the first gas inlet of the first ion source is connected to the first branch of the splitter, the second gas inlet of the first ion source is connected to the reaction gas inlet inside of the ionizing chamber; and the second branch of the splitter is left unconnected inside of the ionizing chamber. When a calibration is conducted, a reference gas source is connected to the sample gas inlet, and a reaction gas source is connected to the reaction gas inlet.

The reference gas is introduced through the sample gas inlet into the ionizing chamber, and a part of the reference gas introduced is further introduced into the first ion source through the first inlet, and the other part of the reference gas is discharged into the ionizing chamber through the second branch of the splitter. The reference gas discharged in the ionizing chamber is evacuated therefrom by the vacuum pump. The split ratio of the reference gas, which is the ratio of the amount of reference gas delivered to the ion source to that discharged in the ionizing chamber, can be determined by appropriately determining the flow resistances of the two splitting paths, which can be adjusted by appropriately setting the inner diameter, length and shape of the paths. Thus the reference gas can be introduced into the first ion source at a desired low flow rate.

After the calibration is finished, the reference gas supply to the ionizing chamber is stopped. Then the ions and gas in the ion source immediately flow back through the first gas inlet, first branch of the splitter and the second branch, and are discharged into the ionizing chamber. Thus the subsequent measurement of an unknown sample gas can be started in a short time.

When the mass spectrometer is used in the PCI mode and the sample gas-is a fluorine compound gas: the second ion source is placed in the ionizing chamber; the third gas inlet of the second ion source is connected to the first branch of the splitter; and the reaction gas inlet is connected to the second branch of the splitter in the ionizing chamber. According to such a setup, all the sample gas (or a reference gas) and all the reaction gas are mixed and supplied together to the second ion source, which increases the pressure in the ion source and the measurement is made at a higher sensitivity and accuracy.

In the above example, it is supposed that the reference gas is detected at a higher sensitivity in the NCI mode than in the PCI mode. If another reference gas is used so that the detecting sensitivity is higher in the PCI mode than in the NCI mode, the structure and connections of the two modes described above should be reversed.

DETAILED DESCRIPTION OF A PREFERRED EMBODIMENT

Figure 1:
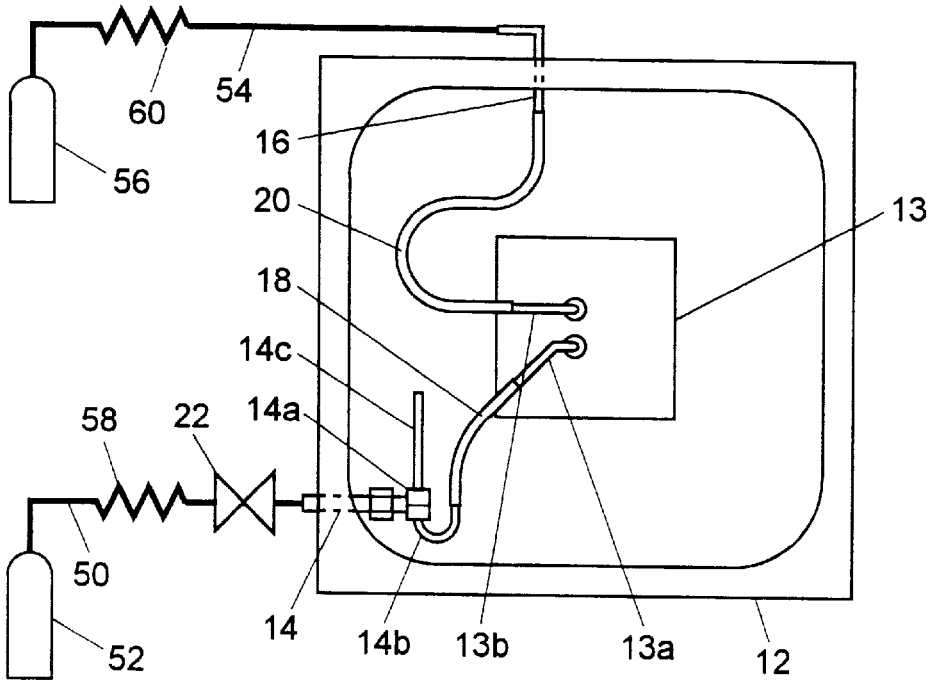
FIG. 1 is a connection diagram around the ionizing part of a mass spectrometer according to the present invention in the NCI mode.
Figure 2:
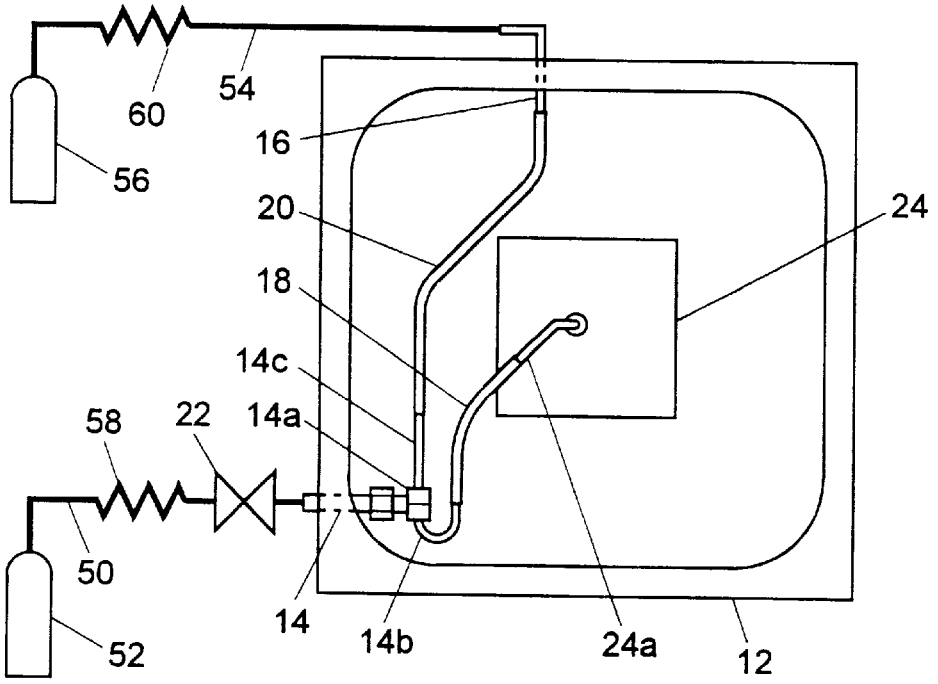
FIG. 2 is the connection diagram in the PCI mode.

A mass spectrometer embodying the present invention is described referring to FIGS. 1 and 2 which show the ionizing part of the mass spectrometer. When a calibration is conducted in the NCI method, the ionizing part is arranged as shown in FIG. 1. In the ionizing chamber 12 is placed an ion source 13 specified for the NCI method. The NCI ion source 13 has two gas inlets 13*a* and 13*b*. In the ionizing chamber 12, a sample gas inlet 14 and a reaction gas inlet 16 are provided in its wall. At an end of the sample gas inlet 14 inside of the ionizing chamber 12 is provided a splitter 14*a*, and a first branch 14*b* and a second branch 14*c* are provided to the splitter 14*a*. The first branch 14*b* is connected to the first gas inlet 13*a* of the ion source 13 via a flexible tube 18, but the second branch 14*c* is left unconnected. The reaction gas inlet 16 is connected to the second gas inlet 13*b* of the ion source 13 via another flexible tube 20.

The other end of the sample gas inlet 14 is connected to a sample gas source 52 outside of the ionizing chamber 12. When a calibration is conducted, a reference gas is contained in the sample gas source 52. The other end of the reaction gas inlet 16 is connected to a reaction gas source 56 outside of the ionizing chamber 12. A flow resistance 58 and an ON/OFF valve 22 are provided on the sample gas path 50 from the sample gas source 52 to the sample gas inlet 14, and a flow resistance 60 is provided on the reaction gas path 54 from the reaction gas source 56 to the reaction gas inlet 16.

In a calibration according to the above described setup in the NCI mode, the gases flow as follows. The reference gas from the sample gas source 52 flows through the sample gas path 50 and enters the ionizing chamber 12 through the sample gas inlet 14. The reference gas is split at the splitter 14*a*, where a part is delivered to the ion source 13 through the first gas inlet 13*a*, and the other part is discharged into the ionizing chamber 12 through the second branch 14*c*. The split ratio at the splitter 14*a* is determined by the ratio of the flow resistance of the second branch 14*c* to the combined flow resistance of the first branch 14*b*, the flexible tube 18 and the first gas inlet 13*a*. Thus by appropriately designing the length, shape, inner diameter and other factors influencing the flow resistance of those components, the split ratio can be arbitrarily determined, and the reference gas can be delivered to the ion source 13 at an optimal flow rate.

After a calibration is finished, the ON/OFF valve 22 on the sample gas path 50 is closed. Since the ionizing chamber 12 is evacuated by a vacuum pump (not shown) and the pressure is lower than that in the ion source 13, the reference gas and its ions in the ion source 13, flexible tube 18 and the first branch 14*b* flow back and are discharged in the ionizing chamber 12 in a short time.

When a calibration is conducted in the PCI mode, the ionizing part is arranged as shown in FIG. 2. In the ionizing chamber 12 is placed an ion source 24 specified for the PCI method, which has only one gas inlet 24*a*. The flexible tube 18 from the first branch 14*b* of the splitter 14*a* is fitted to the sole gas inlet 24*a* of the PCI ion source 24. The-reaction gas inlet 16 of the ionizing chamber 12 is connected with the flexible tube 20 to the second branch 14*c* of the splitter 14*a*.

In a calibration according to this structure in the PCI mode, the reference gas from the sample gas source 52 and the reaction gas from the reaction gas source 56 are mixed at the splitter 14*a*, and enters the PCI ion source 24 from the gas inlet 24*a*. Since the reference gas is not split but the entirety is supplied to the ion source 24 in the PCI method of the present embodiment, the pressure in the ion source 24 is adequately high and a sufficient amount of positive ions of the reference gas is produced.

Figure 3:
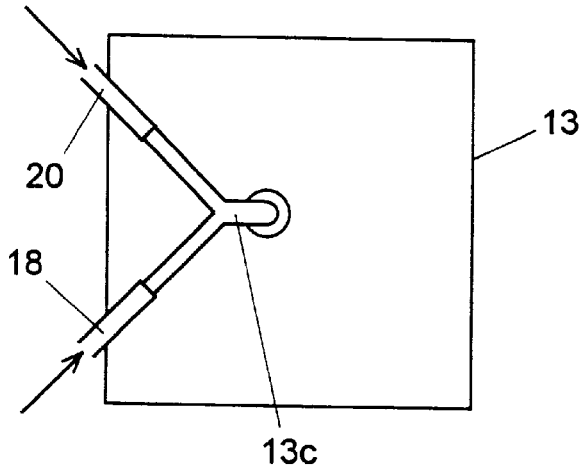
FIG. 3 is another example of the NCI ion source.
Figure 4:
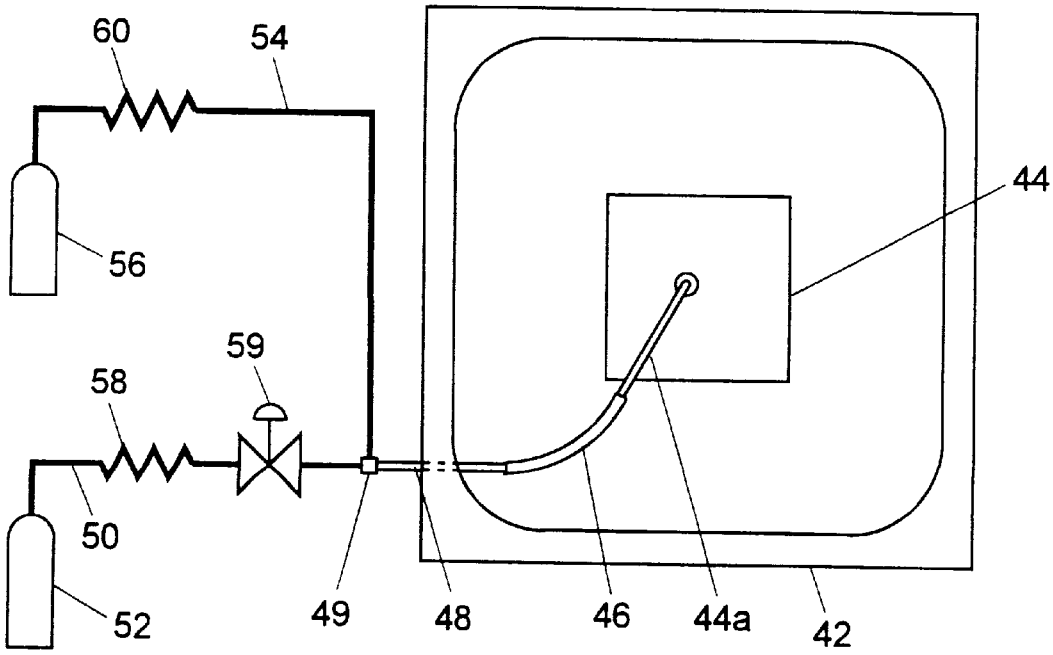
Fig. 4 PRIOR ART
FIG. 4 is a connection diagram around the ionizing part of a conventional mass spectrometer.

FIG. 3 shows another example of the NCI ion source. The NCI ion source 13 in FIG. 3 has a Y-shaped gas inlet 13*c* having two branches. The flexible tube 18 is connected to one of the branches of the gas inlet 13*c* for introducing the sample gas into the ion source 13, and the flexible tube 20 is connected to the other branch of the gas inlet 13*c* for introducing the reaction gas into the ion source 13.

What is claimed is:

1. A mass spectrometer with an ionizing chamber in which either of a first ion source and a second ion source is placed, the mass spectrometer comprising:

a first gas inlet and a second gas inlet provided to the first ion source;

a third gas inlet provided to the second ion source;

a sample gas inlet passing through a wall of the ionizing chamber;

a splitter provided at an end of the sample gas inlet inside of the ionizing chamber having a first branch and a second branch; and a reaction gas inlet passing through the wall of the ionizing chamber, where:

the first gas inlet is connected to the first branch, the second gas inlet is connected to the reaction gas inlet inside of the ionizing chamber, and the second branch is left unconnected inside of the ionizing chamber when the first ion source is placed in the ionizing chamber; and the third gas inlet is connected to the first branch and the reaction gas inlet is connected to the second branch in the ionizing chamber when the second ion source is placed in the ionizing chamber.

2. The mass spectrometer according to claim 1, wherein the first ion source is an NCI ion source for producing negative ions and the second ion source is a PCI ion source for producing positive ions.

3. The mass spectrometer according to claim 1, wherein:

the mass spectrometer further comprises an ON/OFF valve provided on a path connecting the sample gas inlet and a sample gas source; and the ON/OFF valve is opened while a measurement is being carried out and the ON/OFF valve is closed when the measurement is finished when the NCI ion source is placed in the ionizing chamber.

4. The mass spectrometer according to claim 1, wherein flow resistances of the first branch, the second branch, the first gas inlet and a tube connecting the first branch and the first gas inlet are determined so that a split ratio of the sample gas which is a ratio of an amount of the sample gas supplied to the first ion source through the first branch to the amount of the sample gas released in the ionizing chamber through the second branch is at a desired value.

5. A method of using a mass spectrometer including an ionizing chamber in which either of a first ion source and a second ion source is placed, the method comprising steps of:

splitting a sample gas supplied through a sample gas inlet provided in a wall of the ionizing chamber using a three-port connector provided at an end of the sample gas inlet inside of the ionizing chamber into a part supplied to the first ion source and a part released into the ionizing chamber, and supplying a reaction gas supplied through a reaction gas inlet provided in the wall of the ionizing chamber to the first ion source when the first ion source is placed in the ionizing chamber; and making a mixed gas of the sample gas supplied through the sample gas inlet and the reaction gas supplied through the reaction gas inlet at the three-port connector, and supplying the mixed gas from the three-port connector to the second ion source when the second ion source is placed in the ionizing chamber.

6. The method according to claim 5, wherein the first ion source is an NCI ion source for producing negative ions and the second ion source is a PCI ion source for producing positive ions.

7. The method according to claim 5, wherein:

the sample gas inlet is opened while a measurement is being carried out; and the sample gas inlet is closed when the measurement is finished when the first ion source is placed in the ionizing chamber.

8. The method according to claim 5, wherein a reference gas is used as the sample gas, and a split ratio of the reference gas which is a ratio of an amount of the reference gas supplied to the first ion source to an amount of the reference gas released in the ionizing chamber is set at a desired value when the first ion source is placed in the ionizing chamber and a calibration is carried out.

* * * * *